US008162542B2

(12) United States Patent
Harman et al.

(10) Patent No.: US 8,162,542 B2
(45) Date of Patent: Apr. 24, 2012

(54) ENVIRONMENT CONTROLLED CARGO CONTAINER

(75) Inventors: Donald Edward Harman, Anchorage, AK (US); Kyle Mathias Taylor, Inver Grove, MN (US)

(73) Assignee: Tednologies, Inc., Anchorage, AK (US)

( * ) Notice: Subject to any disclaimer, the term of this patent is extended or adjusted under 35 U.S.C. 154(b) by 537 days.

(21) Appl. No.: 12/380,040

(22) Filed: Feb. 23, 2009

(65) Prior Publication Data

US 2009/0212047 A1 Aug. 27, 2009

Related U.S. Application Data

(60) Provisional application No. 61/031,301, filed on Feb. 25, 2008, provisional application No. 61/051,263, filed on May 7, 2008.

(51) Int. Cl.
*G01K 1/00* (2006.01)
*B65D 88/00* (2006.01)

(52) U.S. Cl. ..... 374/208; 374/141; 374/109; 220/1.5

(58) Field of Classification Search ..... 374/4, 5, 374/8, 29–30, 110, 112, 115, 109, 100, 141, 374/147, 148, 132, 120, 134, 135, 137, 165–167, 374/208; 165/253, 58, 67, 80.1; 62/440, 62/457.1, 457.9, 498, 125, 127; 220/578, 220/1.5

See application file for complete search history.

(56) References Cited

U.S. PATENT DOCUMENTS 5,337,579 A * 8/1994 Saia et al. ..... 62/239
5,953,928 A * 9/1999 Saia et al. ..... 62/239
6,311,509 B1 11/2001 Cartwright et al.
7,263,855 B2 * 9/2007 Meyer et al. ..... 62/371
7,690,837 B2 * 4/2010 Ahlers et al. ..... 374/8
2002/0020188 A1 2/2002 Sharon et al.
2003/0019870 A1 1/2003 Ekerot et al.
2004/0200232 A1 10/2004 Gano et al.
2004/0226309 A1 * 11/2004 Broussard ..... 62/236
2004/0262345 A1 * 12/2004 Polburn et al. ..... 224/275
2005/0201843 A1 * 9/2005 Nelson et al. ..... 410/130
2006/0178779 A1 8/2006 Ahlberg
2007/0289976 A1 * 12/2007 Meyer et al. ..... 220/592.09
2008/0231459 A1 * 9/2008 Corder ..... 340/572.7
2009/0315726 A1 * 12/2009 Popp et al. ..... 340/584
2010/0098131 A1 * 4/2010 Ahlers et al. ..... 374/8
2010/0119323 A1 * 5/2010 Nelson ..... 410/135
2011/0018205 A1 * 1/2011 Nelson ..... 277/315
2011/0067852 A1 * 3/2011 Farrar ..... 165/263
2011/0095866 A1 * 4/2011 Karr ..... 340/10.1
2011/0247356 A1 * 10/2011 Krosse et al. ..... 62/457.1

FOREIGN PATENT DOCUMENTS

SU 686021 A * 9/1979

OTHER PUBLICATIONS

Envirotainer.Com, "Envirotainer Container RKN t1/t2," 3 pages, Feb, 18 2009.
Amsafe.Com, "Temperature Controlled Cargo Container," 2 pages, Feb. 18, 2009.
Safetemp.Com, "AcuTemp RKN Temperature Management Cargo Unit," 2 pages, copyright 2008.

* cited by examiner

*Primary Examiner* — Gail Verbitsky
(74) *Attorney, Agent, or Firm* — Francis L. Conte

(57) ABSTRACT

A cargo container includes a cargo box affixed atop a hollow base, with the base including forklift tunnels extending therethrough with elongate bays disposed parallel thereto. Each bay includes a removable tray for receiving electrical batteries. And, a temperature control system is disposed on a sidewall adjoining the base.

20 Claims, 5 Drawing Sheets

ENVIRONMENT CONTROLLED CARGO CONTAINER

This application claims the benefit of U.S. Provisional Application Nos. 61/031,301 filed Feb. 25, 2008 and 61/051,263 filed May 7, 2008.

BACKGROUND OF THE INVENTION

The present invention relates generally to cargo containers, and, more specifically, to temperature controlled aircraft cargo containers.

Cargo containers such as those used in aircraft are strictly controlled by various government regulations. Weight and safety are paramount design objectives for aircraft cargo containers.

Temperature sensitive cargo increases the complexity of container design for transporting pharmaceuticals, biomedical products, electronics, food, and other perishable items in hot or cold environments for the duration of the transport.

However, adding refrigeration or heating systems to a cargo container decreases the available space for transporting cargo, and correspondingly increases associated costs.

Such environmental control systems also affect the basic design of the cargo container, its structural integrity, and weight distribution which affect performance in the cargo aircraft.

Accordingly, it is desired to provide an improved aircraft cargo container having an environmental control system integrated therein.

BRIEF DESCRIPTION OF THE INVENTION

A cargo container includes a cargo box affixed atop a hollow base, with the base including forklift tunnels extending therethrough with elongate bays disposed parallel thereto. Each bay is configured to receive electrical batteries. And, a temperature control system is disposed on a sidewall adjoining the base.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
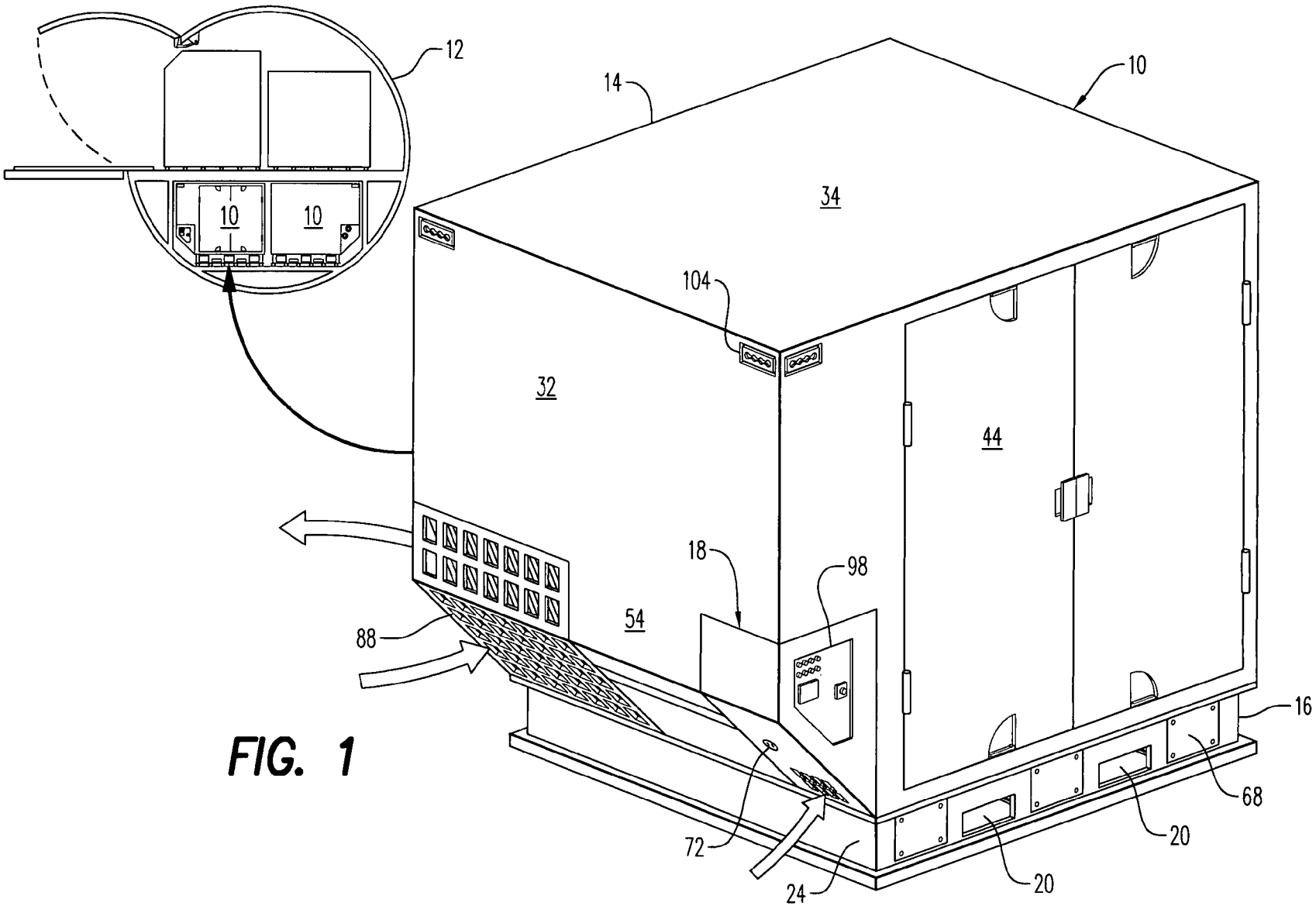
FIG. 1 is an isometric view of an environmentally controlled cargo container configured for transport in a cargo aircraft.

Illustrated in FIG. 1 is an insulated cargo container 10 specifically configured for transport in the lower cargo bay of a transport aircraft 12, shown in relevant fuselage section.

The container 10 is an assembly of interrelated components, including a cargo box or main body 14 affixed atop a hollow base 16. A temperature control system (TCS) 18 is disposed on a supporting sidewall of the box 14 adjoining the base 16 for controlling temperature inside the box 14.

The container 10 may be specifically referred to as a Tracking Environmental Deviation System Box (TEDSBOX) for its ability to monitor and record any deviation in temperature inside the box during its transport of suitable cargo therein, which requires either heating or cooling to specified temperature. The TEDSBOX is a self powered, temperature controlled cargo container 10 designed to transport cargo in a steady state environment. The TEDSBOX is designed for use in all modes of transportation including transport and normal category ship, rail, truck, and especially aircraft.

The specific geometry and design of the TEDSBOX is centered on transport aircraft requirements, requiring stringent regulation which will encompass compliance with all modes of transportation. The overall TEDSBOX container design may conform to National Aerospace Standard (NAS) NAS3610 and FAA Technical Standard Order (TSO) No. C90c.

These specifications dictate the external and interface geometries of the TEDSBOX, in additional to the compliance requirements related thereto. Federal Aviation Administration (FAA) transport category aircraft compliance requirements for the Temperature Control Systems (TCS) are encompassed by 14 CFR 21.305(d) and FAA Order 8150.4. International Air Transport Association (IATA) ULD Technical Manual, 20th edition, may also be employed to provide geometric, marking, and operational documentation specifications.

The base 16 is preferably made from conventional aircraft grade aluminum to provide a sturdy structure that provides an interface between the aircraft (or other vehicle) and the container body or box 14. The base may be attached to the floor of the aircraft via NAS3610 interface geometry, and the box is suitably attached to the base.

The base 16 is in the preferred form of a modified pallet, including a pair of forklift tunnels 20 extending laterally therethrough which are configured to receive the typical tines of a conventional forklift (not shown) for conveniently moving and transporting the entire container 10 as required for loading and unloading from its transport vehicle, such as the exemplary aircraft.

Figure 2:
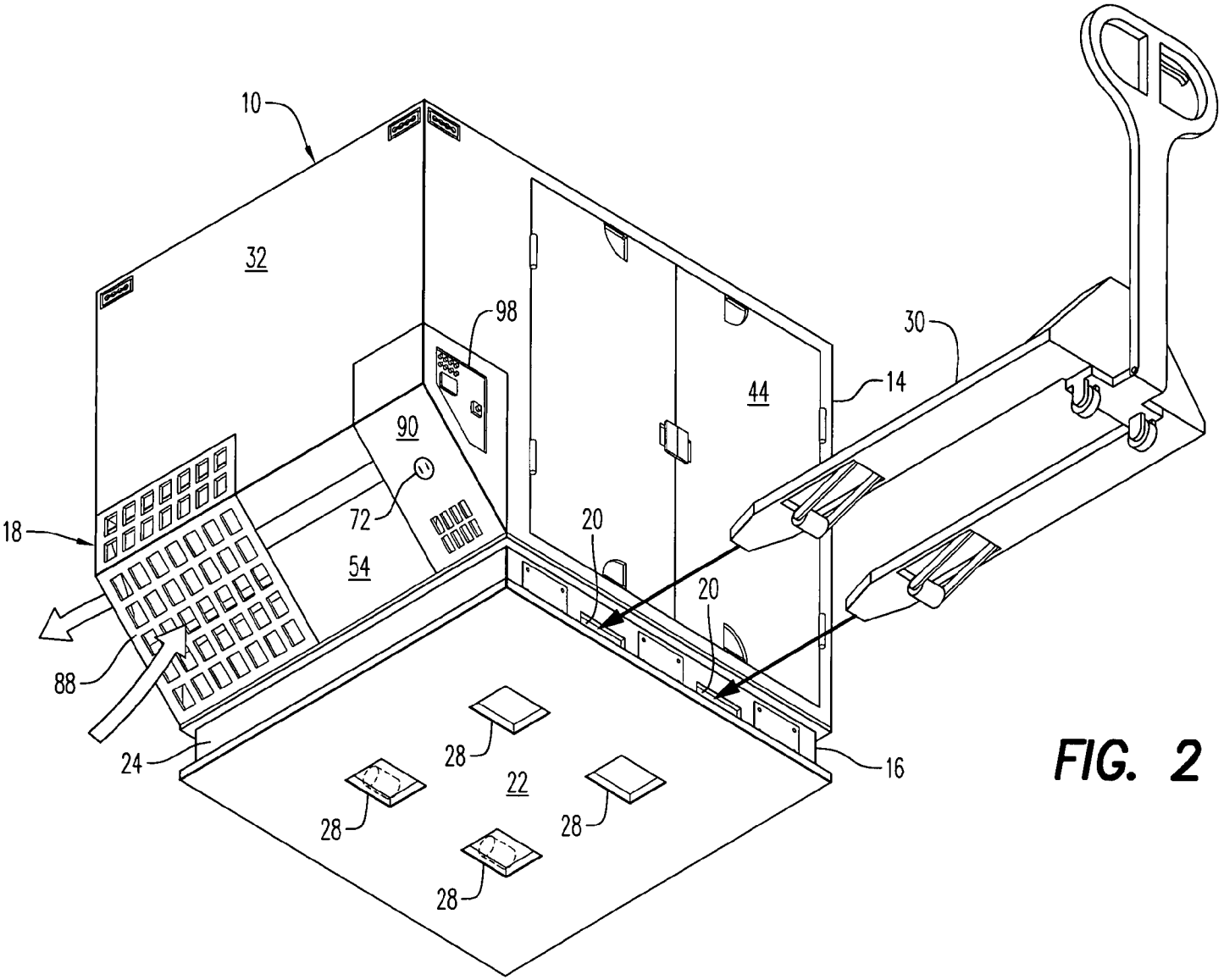
FIG. 2 is an underside isometric view of the cargo container shown in FIG. 1 having an integral base with forklift tunnels for transport by forklift or pallet jack.

As shown in FIG. 2, the container base 16 preferably includes a flat bottom 22 for rolling without obstruction on the typical rollers or bearings provided in the aircraft floor.

Figure 3:
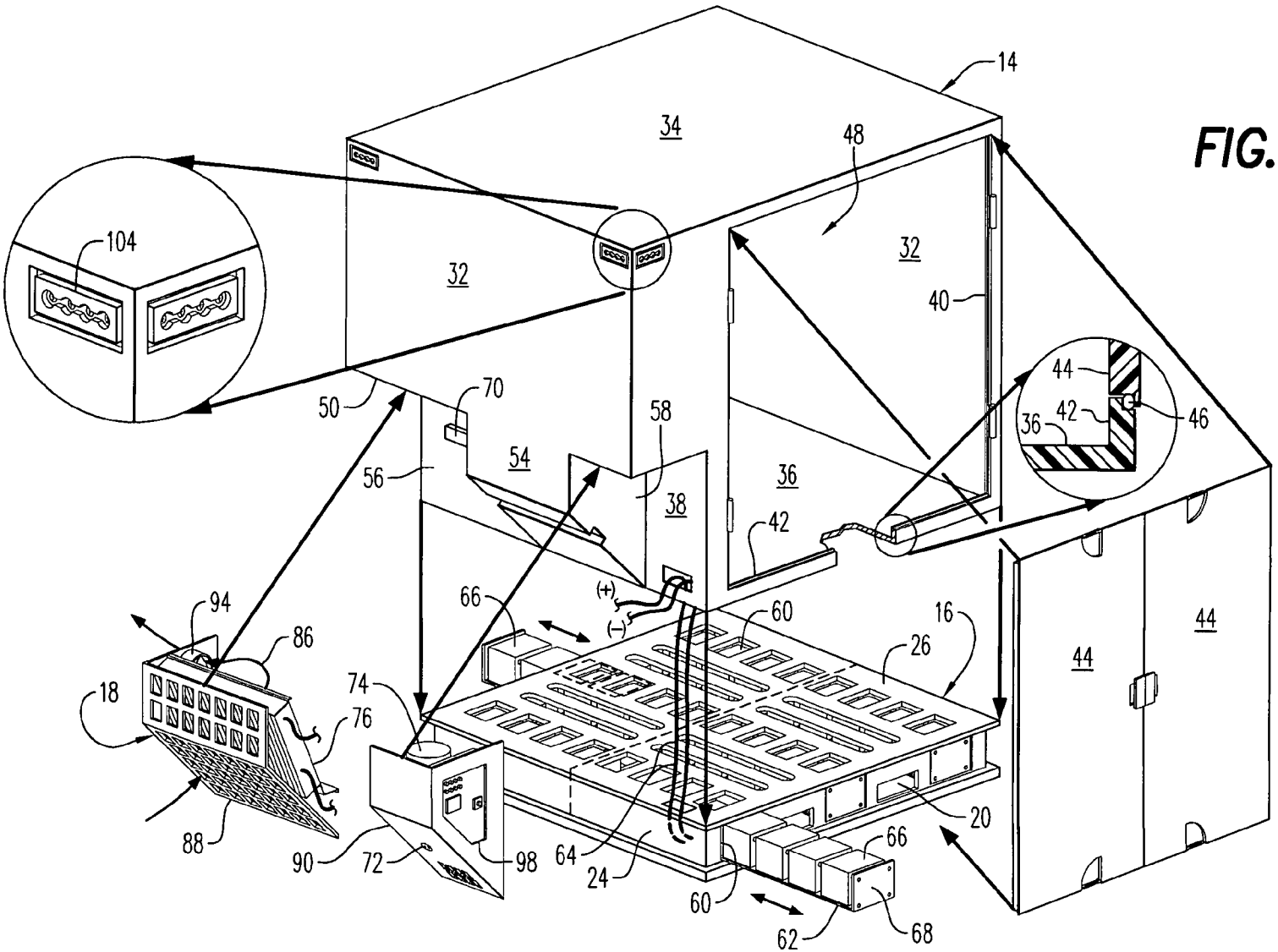
FIG. 3 is an exploded view of the cargo container from FIG. 1.

The palletized base is surrounded by an integral structural sidewall or skirt 24, and may have internal structural ribs as desired, and may also be covered by an optional top wall 26 having numerous cutout holes to reduce the weight thereof as shown in FIG. 3.

The pallet bottom 22 is in the form of a flat plate preferably having duplicate pairs of jack holes 28 therein aligned with the forklift tunnels 20 as shown in FIG. 2. The holes 28 are specifically placed at both ends of the base so that upon insertion of the tines from a conventional pallet jack 30, the supporting tine rollers will be aligned atop the respective holes 28 for allowing transport of the container by moving the jack 30.

The jack holes 28 are not required for the typical forklift whose tines are well carried by the forklift vehicle itself.

Figure 4:
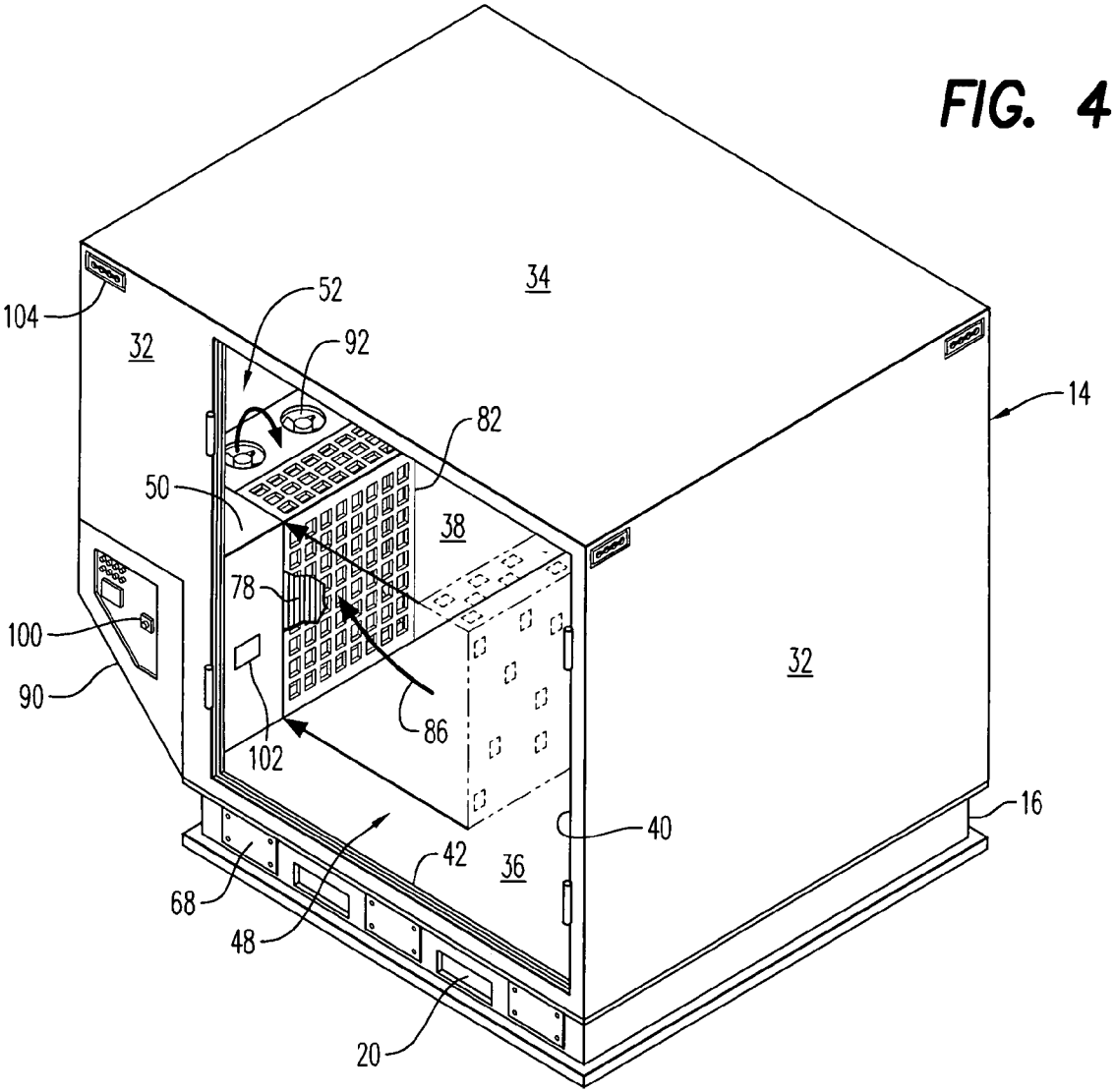
FIG. 4 is an internal isometric view of the cargo container shown in FIG. 1.

The cargo box 14 is illustrated in exploded view in FIG. 3, and with certain internal features visible in FIG. 4. The cargo box 14 is bound on four sides by perimeter sidewalls 32, bound at the top by an integral roof 34, and bound at the bottom by an integral floor 36.

The box further includes in particular a truncated lower sidewall or kneewall 38 extending vertically upwardly from the floor 36 and base 16 across the full width of the box for supporting the TCS 18 outside or externally of the insulated box 14 itself.

The box 14 is preferably a unitary or one-piece component made from conventional aircraft grade composite materials, including for example fiberglass in resin matrices. It is conventionally configured for suitable thermal insulation in sandwich wall construction with internal and external structural skins bounding an internal insulating core.

Access inside the box is provided by a rectangular portal 40 in one of the sidewalls 32 elevated above the floor 36 by a riser threshold or lip 42.

A pair of cargo doors 44 are hinge mounted to the box 14 to cover the portal 40 and fully enclose the box 14. Each door has a suitable sealing gasket 46 around its perimeter configured to engage a small notch in the perimeter of the portal 40 and lip 42 to provide a tight fluid seal therewith.

The height of the lip 42 is selected to ensure that any fluid leaking from the cargo inside the box is captured in a pool or reservoir bound by the lip and lower sidewalls above the floor. This prevents leaking of the container itself, and can avoid the need and expense of prematurely removing the container from the aircraft during transport.

The container box has two large storage portions including a main internal storage space defining a main cargo box 48 which is a rectangular container with maximum height, width, and depth behind the double access doors 44, shown both in FIGS. 3 and 4.

The container also includes a horizontal front shelf 50 best shown in FIG. 4 that is disposed laterally atop the lower kneewall 38 and TCS 18 to provide additional internal storage space in the form of a secondary cargo box 52 extending laterally from the main cargo box 48 above the shelf 50.

The kneewall 38 defines the forwardmost end of the box floor 36 which itself is coextensive in surface area with the underlying pallet base 16. The shelf 50 therefore extends further forward and is cantilevered forwardly from the top of the kneewall 38 to in turn cantilever forward both the secondary storage box 52 disposed above the shelf 50, and the TCS 18 suspended therebelow.

The vertical perimeter sidewalls 32 and kneewall 38 along with the horizontal roof 34, floor 36, and shelf 50 integrally bound the contiguous main and secondary box portions 48,52 for maximizing useful storage space inside the container, with substantially full access to the inside thereof by the large double doors 44.

As shown in FIG. 3, the container 10 also includes an external cabinet or housing 54 suspended below the secondary box 14 outside the kneewall 38. The housing 54 extends integrally downwardly from the bottom of the front sidewall and the underside of the shelf 50, and along the outer surface of the kneewall 38 to increase the structural rigidity of the box and provide load support for the internal shelf 50.

The housing 54 is narrower in width than the kneewall 38 and laterally offset inwardly from opposite sidewalls to define left and right chambers or seats 56,58 on opposite sides of the housing 54 for distributing corresponding components of the TCS 18 below the secondary box 14 outside the kneewall 38.

The TCS components are laterally distributed across the full width of the kneewall and in the lower half portion of the box to minimize lost internal cargo space and lower the center of gravity of the container for increasing its stability both empty, and when loaded with cargo.

In the exemplary aircraft cargo container configuration illustrated in FIGS. 2 and 3, the TCS 18 and housing 54 preferably share a common bevel or slope downwardly from the shelf to the base 16 to match the typical LD3-type standard cargo container configuration. This beveled lower surface permits loading of the LD3 container in the lower deck of the round aircraft fuselage as shown in FIG. 1, with the bevel closing matching the internal contour of the fuselage to maximize cargo space.

Since maximizing cargo capacity is the paramount objective of the cargo container, with structural integrity and stability being additional objectives, the TCS 18 and its power source must be minimized in size and suitably located to meet these objectives.

By locating the TCS 18 behind the kneewall 38 in the lower portion of the container, the substantial volume of the secondary cargo box 52 is made available to supplement the primary storage volume of the main cargo box 48.

And by specially modifying the pallet base 16, the power supply for the TCS may be integrated therein for further distributing the requisite components, and providing additional advantages from the otherwise unused volume of the base.

As best shown in FIG. 3, the base 16 further includes a plurality of elongate bays 60 disposed parallel to the forklift tunnels 20. The bays are preferably disposed in pairs on opposite sides of the base 16. And in the exemplary configuration shown, three pairs of bays are provided, with three bays on opposite sides of the base, for a total of six bays.

Each bay 60 preferably includes a removable battery tray 62 therein, and suitable electrical power cables 64 are routed between the base and TCS 18 to provide electrical power thereto. Since the base 16 is mounted directly below the floor 36, direct access is readily available for routing the electrical cables 64 or other desired leads to the TCS located closely behind the lower kneewall 38.

The base 16 is therefore specially configured to house banks of rechargeable (DC) batteries 66 which may be used to power the insulated container when desired. The base, and its internal load of batteries, is readily forkliftable from its two sides through the forklift tunnels 20 built into the base.

Any number and type of conventional or advanced-design batteries 66 may be mounted inside the hollow base 16, such as government (FAA) approved sealed valve-regulated lead acid batteries or non-hazmat standard aviation batteries in suitable voltage, such as 12 volt or 24 volt. A 24 volt system is preferred for improving the efficiency of the TCS 18, including the electrical compressor described hereinbelow.

Each tray 62 in the base 16 may be configured to support and mount up to four batteries 66, with a potential for the base to contain a maximum of twenty-four batteries in the six bays thereof. If 24-volt batteries are used, they may simply be wired in parallel to each other for providing power to the TCS. If 12-volt batteries are used, they may be simply wired in series pairs to obtain the desired 24 volts, with the pairs then being wired in parallel.

A significant advantage of the container base 16 is the introduction therein of the removable battery banks. The number of batteries and their configuration in banks may be varied as desired for the type of batteries used, and the power load requirements desired. This allows the operator to select the necessary amount of battery power and weight for the particular mission, maximizing container useful load. Between 0 and 6 banks of batteries can be installed depending on the mission.

FIG. 3 illustrates the placement of the forklift tunnels 20 in the middle of the base 16, which permits the bays 60 to be disposed both inboard between the two tunnels 20 as well as outboard thereof for maximizing battery volume. The base skirt 24 surrounds the base and is suitably high to provide adequate access for mounting the battery banks, and the skirt provides structural support to the base, and its load of batteries therein.

The base top wall 26 is optional, and may be used to increase strength, and optional internal partitions or ribs may also be used inside the base as required for separating and supporting the rows of batteries therein.

Each bay 60 has an associated side cover 68, which may be screw fastened to the base to secure the tray and batteries therein. And, the multiple bays permit suitable distribution of the batteries when less than the full twenty-four maximum are used. For example, small battery banks may be preferentially located in the middle bay between the forklift tunnels for centralizing the center of gravity of the container.

And, since the batteries are located in the base, they themselves also lower the center of gravity of the entire container, both loaded or empty of cargo to enhance the stability thereof both during ground use and aircraft transport.

In the event that no batteries are installed, the container 10 can act as a normal (passive) insulated cargo unit, with maximum useful load. With between 1 to 6 battery banks installed, the container can operate in any of its operational modes, with duration limited by available battery power. Or, external electrical power may be provided to the TCS for active mode of operation.

Each battery bank may have up to four sealed lead acid aircraft batteries, for a total of up to 24 batteries. In addition, when any number of batteries are installed, the unit can be plugged into ground power to operate the TCS 18 and charge the batteries simultaneously.

In this regard, an electric battery charger 70 may be suitably mounted to the container, as shown for example in the external left seat 56 of FIG. 3, and electrically joined to the battery banks. An electrical receptacle or outlet 72 may be exposed on the container for connecting an external power cable to the charger 70 to recharge the batteries, or directly power the TCS 18 as desired.

The TCS 18 is an active system powered by the batteries 66 or external power source, and preferably includes both a refrigerator and a heater distributed in the left and right seats 56,58 and housing 54, with the batteries being further distributed in the base 16 for the exemplary advantages disclosed above.

Figure 6:
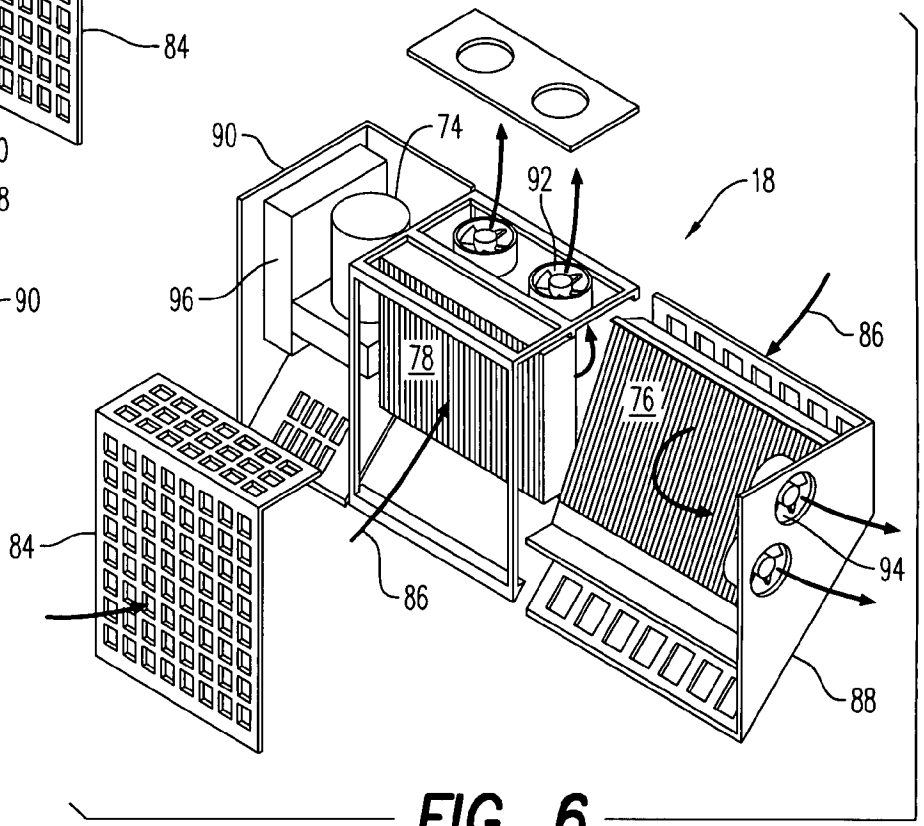
FIG. 6 is an exploded inside view of the temperature control system shown in FIG. 3.
Figure 5:
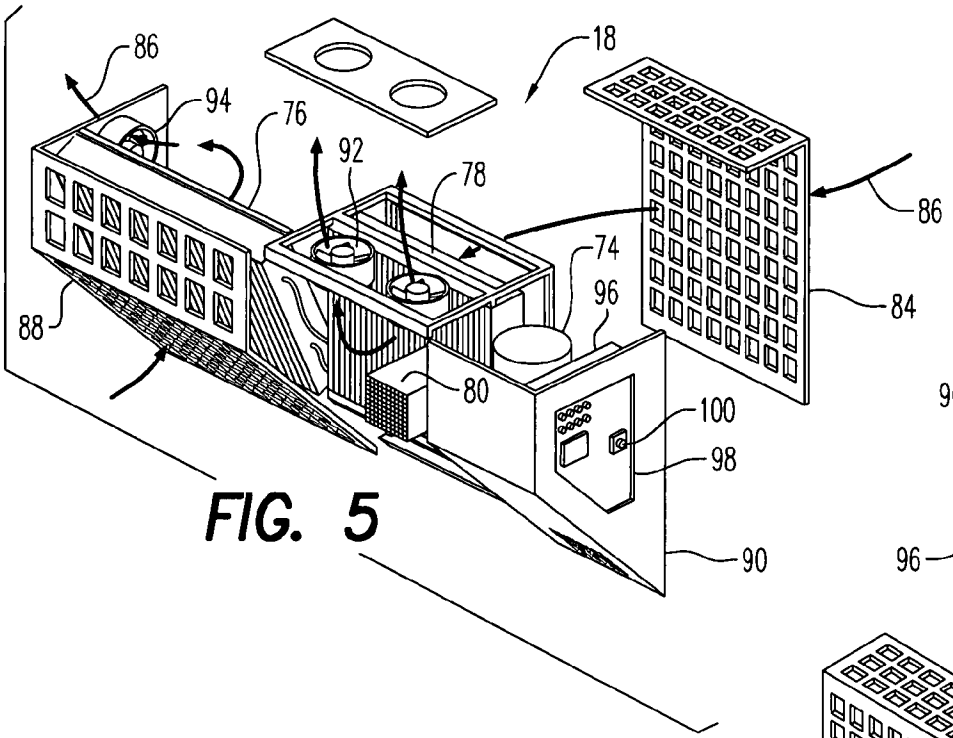
FIG. 5 is an exploded outside view of the temperature control system shown in FIG. 3.

The refrigerator component of the TCS 18 may have any conventional parts including a compressor 74 mounted in the right seat 58 as shown in FIGS. 3, 5, and 6. A cooperating condenser 76 is mounted in the left seat 56. And, an evaporator 78 is mounted inside the housing 54, as best shown in FIG. 4, which housing provides a flow duct in flow communication with the cargo box, but isolated from the other components in the two seats 56,58.

Suitable refrigerant lines or tubes join together the compressor 74, condenser 76, and evaporator 78 for providing the requisite cooling loop or circuit in conventional fashion, with one tube being routed through a recessed external channel at the bottom of the closed housing 54, and the other tubes being routed through sealed apertures in the sides of the housing.

In this way, the evaporator 78 may be isolated inside the housing 74 for maximizing cooling efficiency, with the compressor 74 being located in the right seat 58 outside the housing, and the condenser 76 being located in the left seat 56 also outside the housing.

An electrical heater 80, shown in FIG. 5, may also be mounted inside the housing 54 between the housing front wall and the evaporator 78.

Both the heater 80 and compressor 74 are suitably joined to the batteries 66 when desired, for either heating or cooling the cargo space inside the container box. Any suitable conventional electrical heater may be used. For the compressor 74, one commercially available 24-volt model is the Danfoss BD350GH, available from Danfoss, Inc., Carol Stream, Ill.

As shown in FIG. 4, the kneewall 38 and shelf 50 include a large common aperture 82 matching the width of the external housing 54 to provide flow communication between the housing and the cargo box.

An internal grill 84 is disposed in the aperture 82 flush or coplanar with both the kneewall and shelf to cover the housing 54 and provide flow communication with the evaporator 78 and heater 80 mounted therein. In this way, internal airflow 86 may circulate between the housing and cargo box for either heating or cooling the cargo itself, when desired.

An external grill 88 covers the condenser 76 on the left side of the housing 54 to enclose the left seat 56 as shown in FIGS. 3, 5, and 6, and permits additional external airflow 86 to circulate through the condenser 76 and remove heat from the compressed refrigerant during operation.

An external fairing 90 covers the compressor 74 on the opposite right side of the housing 54 and encloses the right seat 58. The fairing 90 includes a small grill for circulating purge air through the right seat 58 in which the compressor itself generates additional heat during operation.

The left grill 88 shown in FIG. 2 is preferably coplanar with the exposed surfaces of the housing 54, and with the right fairing 90 to provide the common slope or bevel of the suspended TCS 18 downwardly to the base 16 in the typical LD3 cargo container configuration.

As shown in FIGS. 4-6, the TCS 18 further includes a pair of internal evaporator fans 92 mounted in the shelf 50 in flow communication with the housing 54 and secondary box 14 for circulating the internal airflow 86 therethrough.

A pair of external condenser fans 94 are shown in FIGS. 3, 5, and 6 suitably mounted in the left seat 56 for circulating the external airflow 86 through the external grill 88 and condenser 76.

A suitable electrical controller 96 is mounted in the right seat 58 behind the fairing 90 as shown in FIGS. 3, 5, and 6 for controlling operation of the entire TCS 18, including recharging of the batteries. The controller 96 includes an exposed control panel 98 mounted in the side of the fairing 90 which contains all suitable switches, dials, and monitors for setting and controlling the desired internal temperature of the cargo box.

In particular, the TCS includes a suitable thermostat 100 for setting the desired cargo temperature. The thermostat may be a conventional Dixell digital device exposed on the control panel, and having a temperature sensor mounted inside the cargo box.

The TCS 18 provides (i) active temperature control of the container interior temperature, (ii) a recharging means for the battery banks, and (iii) an operator interface.

The refrigeration portion of the TCS is conventional in nature, and is assembled from commercially available refrigeration components in a new, distributed combination of components.

The heating system is also a commercially available heating unit.

Using the refrigeration and heating systems, container interior temperature may be maintained between approximately 36 and 86 degrees F. for the duration of battery life, or indefinitely when the unit is plugged into ground power.

Temperature control is accomplished with a simple digital thermostat controlling the heater and refrigeration compressor through suitable switches.

The conventional battery charger 70 in the TCS is connected to the battery banks in the base assembly to perform battery charging functions. A suitable State of Charge (SOC) unit may also be housed in the TCS and connected to the base assembly to provide a determination of battery life, which can be displayed on the operator interface.

The operator interface or control panel 98 allows the operator to select the mode of operation, test fail-safe functions, and set the interior temperature. The operator interface may also incorporate a fault display.

Container interior temperature recording may be accomplished using a commercially available passive Radio Frequency Identification (RFID) tag 102 mounted internally along the kneewall 38 as shown in FIG. 4, for example.

The container 10 has several modes of operation. In the cooling mode, the compressor 74 may be powered by the internal batteries or external power source to circulate cooling airflow through the evaporator 78 inside the cargo box, with temperature control by the set temperature of the thermostat.

In the heating mode, the heater 80 is instead powered by the batteries or external power source to circulate heated air through the heater inside the cargo box, with temperature control set by the thermostat.

In a manual mode, the refrigeration and heating systems are disabled and the evaporator fans 92 are set to run in order to circulate air over a cooling media such as dry ice or gel packs, which may be conveniently mounted on suitable racks (not shown) atop the flat shelf 50 illustrated in FIG. 4. This evaporator manual mode of operation allows cooling below the 36 degree F. capability provided by the refrigeration system.

By selectively distributing the TCS 18 and batteries 66 behind the kneewall 38 and inside the pallet base 16, the resulting cargo container 10 enjoys the many advantages disclosed above. The insulated cargo box 14 itself may have maximum volume or storage space for the intended cargo, with the TCS and batteries being preferentially located to minimize lost cargo space under the given or predetermined configuration and size limits of the container for the specific application, such as the LD3 container application for cargo aircraft.

And, quite significantly, the batteries are isolated inside the base below both the cargo itself, and the TCS behind the kneewall to minimize the possibility of damage thereto during rough handling or transport, while maximizing stability with the reduced elevation center of gravity of the container.

As shown in FIG. 3, the cargo box 14 may also include recessed tiedown slots 104 at the four top corners thereof to which tiedown straps may be conveniently attached to further secure the container as required. The tiedown slots may have any conventional configuration recessed into the four top corners for additional advantage.

The remainder of the cargo container may otherwise be conventional with additional features provided for further enhancing the cargo carrying capability thereof, or the operation of the integrated temperature control system thereof.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A cargo container comprising:

a cargo box affixed atop a hollow base;

a temperature control system (TCS) disposed on a sidewall of said box adjoining said base for controlling temperature inside said box; and said base including a pair of forklift tunnels extending laterally therethrough, and a plurality of the elongate bays disposed parallel thereto, with each bay including a removable tray therein and electrical power cables joined to said TCS.

2. A container according to claim 1 wherein:

said cargo box includes a truncated kneewall extending upwardly from said base for supporting said TCS externally of said box; and said box includes a shelf disposed laterally atop said kneewall and TCS to define a secondary cargo box extending laterally from a main cargo box atop said base.

3. A container according to claim 2 wherein said TCS, shelf, and secondary box are cantilevered outwardly from said base.

4. A container according to claim 2 further comprising an external housing suspended below said secondary box outside said kneewall, and being narrower than said kneewall to define left and right seats on opposite sides of said housing for distributing corresponding components of said TCS below said secondary box outside said kneewall.

5. A container according to claim 4 wherein said TCS and housing have a common bevel downwardly from said shelf to said base.

6. A container according to claim 4 wherein said kneewall includes an internal grill covering said external housing in flow communication therewith.

7. A container according to claim 4 wherein said TCS comprises both a refrigerator and a heater distributed in said left and right seats and housing.

8. A container according to claim 4 wherein said TCS includes a refrigerator comprising a compressor mounted in said right seat, a condenser mounted in said left seat, and an evaporator mounted inside said housing.

9. A container according to claim 4 wherein said TCS includes an electrical heater mounted inside said housing.

10. A container according to claim 4 wherein said TCS comprises:

a refrigerator including a compressor mounted in said right seat, a condenser mounted in said left seat, and an evaporator mounted inside said housing; and an electrical heater mounted inside said housing adjacent said evaporator.

11. A container according to claim 10 further comprising:

an internal grill disposed in said kneewall over said housing in flow communication with said evaporator and heater;

an external grill covering said condenser on one side of said housing; and an external fairing covering said compressor on the opposite side of said housing being coplanar therewith and with said external grill.

12. A container according to claim 11 further comprising:

an internal fan mounted in said shelf in flow communication with said housing and secondary box for circulating airflow therethrough; and an external fan mounted in said left seat for circulating airflow through said external grill and condenser.

13. A container according to claim 10 further comprising a controller mounted in said right seat for controlling operation of said TCS.

14. A container according to claim 2 wherein said bays are disposed both between said tunnels and outboard thereof.

15. A container according to claim 2 wherein said bays are disposed in pairs on opposite sides of said base.

16. A container according to claim 2 further comprising a plurality of batteries disposed atop one of said trays in one of said bays, and electrically joined to said TCS for providing electrical power thereto.

17. A container according to claim 2 wherein said base includes a flat bottom and duplicate pairs of jack holes therein aligned with said forklift tunnels.

18. A container according to claim 2 wherein said cargo box further includes recessed tiedown slots at four top corners thereof.

19. A container according to claim 2 wherein said cargo box comprises:

vertical perimeter sidewalls having an integral roof and integral floor collectively bounding said main and secondary box portions thereof;

a portal in one of said sidewalls elevated above said floor by a riser lip; and a cargo door mounted to said box to cover said portal and fully enclose said box.

20. A cargo container comprising:

a cargo box bound by perimeter sidewalls, roof, and floor, and including a vertical kneewall and adjoining horizontal shelf dividing said box into a main cargo box atop said floor and an integral secondary cargo box atop said shelf;

an external housing suspended below said secondary box outside said kneewall, and being narrower than said kneewall to define left and right seats on opposite sides of said housing;

a base mounted below said floor and including a pair of forklift tunnels and a plurality of bays supporting a plurality of batteries; and a temperature control system distributed in said left and right seats and housing in flow communication with said cargo box for selectively cooling and heating thereof, and operatively joined to said batteries in said base.

* * * * *